United States Patent [19]

Beurskens et al.

[11] Patent Number: 4,565,944

[45] Date of Patent: Jan. 21, 1986

[54] ELECTRIC LAMP

[75] Inventors: Johannes H. H. Beurskens; Wilhelmus H. F. Winkelmolen, both of Weert, Netherlands

[73] Assignee: U.S. Philips Corporation, New York, N.Y.

[21] Appl. No.: 556,208

[22] Filed: Nov. 29, 1983

[30] Foreign Application Priority Data

Dec. 7, 1982 [NL] Netherlands ..... 8204723

[51] Int. Cl.[4] ..... H01J 5/48; H01J 5/50

[52] U.S. Cl. ..... 313/318; 339/144 R

[58] Field of Search ..... 313/318; 339/144 R, 339/144 T, 145 D, 145 T, 146

[56] References Cited

U.S. PATENT DOCUMENTS

| | | | |
|---|---|---|---|
| 696,100 | 3/1902 | Juge et al. | 313/318 |
| 1,832,751 | 11/1931 | Thomas | 339/146 |
| 2,028,884 | 1/1936 | Thomas | 339/146 |
| 2,064,364 | 12/1936 | Thomas | 339/146 |
| 2,119,681 | 6/1938 | McGowan | 339/146 |
| 2,138,780 | 11/1938 | Birdseye | 339/146 |
| 2,142,072 | 12/1938 | Asmussen et al. | 339/146 |
| 2,157,051 | 5/1939 | Birdseye | 339/146 |
| 2,158,044 | 5/1939 | Haller | 339/146 |
| 2,159,812 | 5/1939 | Malloy | 339/146 |
| 2,403,137 | 7/1946 | Strickland | 339/146 |
| 3,356,984 | 12/1967 | Thorington et al. | 313/318 |

FOREIGN PATENT DOCUMENTS 14290 3/1897 Switzerland .

*Primary Examiner*—Steven Weinstein

*Attorney, Agent, or Firm*—Robert S. Smith

[57] ABSTRACT

The electric lamp in accordance with the invention has a bayonet lamp cap (3) which is coupled to the neck-shaped portion (2) of the lamp envelope (1) by means of projections (7) and guides (8) co-operating therewith. The coupling is locked against displacement by means of a solidified mass (10). The co-operation between the cams (7) and the guides (8) is obtained by a rotation of the lamp cap (3) with respect to the lamp envelope (1) in counterclockwise direction until the cap abuts the envelope, the abutting stopping further rotation.

4 Claims, 4 Drawing Figures

ELECTRIC LAMP

The invention relates to an electric lamp comprising a blown glass lamp envelope having a neck-shaped portion, a bayonet lamp cap, and current-supply conductors extending from contacts on the lamp cap through the wall of the lamp envelope to an electric element arranged inside the lamp envelope; which lamp cap surrounds at least part of the neck-shaped portion and is coupled to the envelope, by means of circumferentially distributed projections and respective guides cooperating therewith, such that an edge of the lamp cap abuts the envelope, the coupling being locked against displacement by means of a solidified mass.

Such a lamp is known from the Swiss Patent Specification No. 14290, published in 1897.

In the known lamp, the coupling between lamp envelope and lamp cap is established by causing the projections and the respective guides to co-operate in that the lamp cap is rotated in clockwise direction with respect to the lamp envelope. After the said Swiss Patent Specification, numerous suggestions have been made to couple a lamp cap mechanically to a lamp envelope. None of these suggestions has proved usable in practice, except the suggestion in which an Edison lamp cap is screwed onto a screw-thread on the neck-shaped portion of the lamp envelope.

The failure of mechanical securing means is probably due to the large spread in the dimensions of glass lamp envelopes, as a result of which mechanical couplings are not rigid, and to the large forces applied very locally to the glass of the lamp envelope when the lamp is placed in a lamp holder or is removed therefrom.

Consequently, the coupling of lamp caps to lamp envelopes is established in practice, except in certain types in which an Edison lamp cap is screwed on, by means of a solidified mass, such as cement. The use of such a mass has the disadvantage, however, of a low (and for certain applications even insufficient) resistance to heat. As a result, the case may arise that lamps—which have operated in a small unventilated room or lamps having a long calculated life, such as infrared radiators, especially in ovens or drying tunnels—upon removal from a lamp holder are no longer secured to their lamp cap or become detached therefrom due to the fact that the lamp cap has become stuck to the lamp holder by corrosion or by cold flow of solder on the contacts of the lamp cap. Situations can then be obtained which are very dangerous and therefore have to be avoided.

The invention has for its object to avoid the said danger by providing a lamp in which the lamp cap is so secured to the lamp envelope that the lamp cap can be removed from the lamp holder together with and simultaneously with the lamp envelope, even if the lamp has operated for a long time at a high temperature. According to the invention, in an electric lamp of the kind mentioned in the opening paragraph, this is achieved in that the guides are so arranged that the coupling is established by relative rotation in the counter clockwise direction between the lamp cap and the lamp envelope, the abutting of the cap against the envelope stopping further rotation.

In the lamp according to the invention, the solidified mass ensures that the lamp can be manipulated without losing the lamp cap and that at the beginning of its life, while being rotated in clockwise direction abouts its axis, the lamp is placed in a lamp holder without the lamp cap becoming detached. In fact, the lamp then has not yet operated for a lengthy period at a higher ambient temperature and the solidified mass, for example, the cement, then still has its large initial strength. When on the contrary the lamp has reached the end of its life and the solidified mass has lost its initial strength—the mass may have become brittle—, the lamp is removed from the lamp holder by counterclockwise rotation. The torque then exerted on the lamp envelope and the opposite torque on the lamp cap produced by friction between the lamp cap and the lamp holder then have a tendency to strengthen the mechanical coupling which has been established by the projections and the respective guides co-operating therewith. An adhesion of the lamp cap to the holder caused by corrosion or in another manner can thus be overcome without separating the coupling between the lamp cap and the lamp envelope.

In the lamp according to the above-mentioned Patent Specification, the solidified mass, by means of which the coupling of the lamp cap to the lamp envelope is locked against displacement, is introduced through an opening provided in the lamp cap. The neck-shaped portion of the lamp envelope has hook-shaped grooves as guides. The lamp cap has projections engaging these grooves and located at the end of these grooves. The solidified mass is provided through the opening in the lamp cap very locally in the bend in the hook-shaped grooves. In this known lamp, the coupling between the lamp cap and the lamp envelope is established by rotating the lamp cap in the clockwise direction with respect to the lamp envelope. When the lamp is placed in the lamp holder, the lamp cap has a tendency to rotate further in the same direction with respect to the lamp envelope. Further rotation is, however, prevented by the mechanical coupling, even if no solidified mass is present. The solidified mass, while still having its initial strength, then has no useful function. However, at the end of the life of the lamp, when it has to be removed from the lamp holder, forces are applied to the lamp envelope and to the lamp cap which just interrupt the mechanical coupling of the lamp cap to the lamp envelope. In the known lamp, it is not until then that the solidified mass needs to be effective. However, due to the thermal load, the mass has then lost its initial strength.

The object of the invention is therefore not achieved in the known lamp and this lamp does not yield an improvement in the said coupling as compared with conventional lamps.

The projections and the guides co-operating therewith can be made in various constructions. For example, the neck-shaped portion of the lamp envelope may have the projections and the lamp cap may have the guides. In this case, the guides may consist of grooves obtained by pressing the wall of the sleeve-shaped lamp cap outwards, or they may consist of slots provided in the wall of the lamp cap by cutting. In other embodiments, the lamp caps have projections on their inner surface and the guides are present in the neck-shaped lamp envelope part.

Various modifications of the last-mentioned embodiment have proved to be advantageous. The guides may be provided in the form of a groove in the neck-shaped portion of the lamp envelope, but may alternatively have the form of a boss, which consequently yields a local increase of the transverse dimension of this lamp envelope part. The guides may be linear and may thus have a constant pitch throughout their length. However, they may alternatively be curved and may have, of axial locations spaced from the free end of the neck-shaped lamp envelope part, a decreasing pitch. The projections on the inner surface of the sleeve-shaped lamp caps may be secured thereto or may be integral with the lamp cap in that they have been obtained by locally depressing the lamp cap. The projections may be rotation-symmetrical or may be elongate in order to provide a larger contact surface area with the guides.

Although a very satisfactory coupling is obtained with the use of two projections and an equal number of guides, a larger number of projections and guides, for example three or four, may be used, which are distributed around the circumference of the lamp cap and the neck-shaped lamp envelope part.

The lamp caps may be made of various materials, such as copper alloys, e.g. brass, or aluminium.

The lamp according to the invention is more particularly suitable to be constructed as a lamp in which during operation the lamp cap is given a high temperature, such as, for example, a bowl mirror lamp, but also as a lamp intended to be operated in a high ambient temperature, such as a baking-furnace lamp, but especially an infrared lamp. Especially the last-mentioned lamp, if intended for industrial application such as in muffle ovens and drying tunnels, is subjected to high temperatures. The last-mentioned lamp has an annular mirror-coated wall portion which joins the neck-shaped lamp envelope part and concentrates the radiation produced by the light source.

The electric element, i.e. the light source, of the lamp may be a filament, which may be arranged in an inner envelope, or a pair of electrodes in an inner envelope filled with an ionizable gas.

As a solidified mass, use may be made, for example, of cement, glue or solder. Very satisfactory results are obtained with masses comprising binder and filling substances. As a binder, use may be made of thermohardening resins or mixtures of thermohardening and thermoplastic resins; the filling substances used may be: calcium carbonate, barium sulphate, aluminium oxide, glass powder, sand, and the like.

The solidified mass may be provided in the gap between the neck-shaped lamp envelope part and the lamp cap. In a very favorable embodiment, the projections and the guides are embedded in the solidified mass. Although the strength of the mass may considerably decrease during the life of the lamp, upon removal of the lamp from the lamp holder the mass increases the area over which forces are applied to the lamp cap and to the neck-shaped lamp envelope part. Thus, larger very locally applied forces are avoided and the risk of damage to the lamp envelope is eliminated.

Embodiments of the lamp according to the invention are shown in the drawing. In the drawing:

BRIEF DESCRIPTION OF THE DRAWINGS

In FIG. 1 the lamp envelope 1 has a neck-shaped portion 2. Current-supply conductors 14 extend from contacts 4 on a bayonet lamp cap 3 through the wall of the lamp envelope 1 to an electric element 5, a filament, arranged inside the lamp envelope. The lamp cap 3 abuts, at an edge 6, the lamp envelope 1 and surrounds part of the neck-shaped portion 2. The lamp envelope 1 has an annular mirror-coated wall portion 17 for concentrating the radiation produced by the filament.

Figure 1:
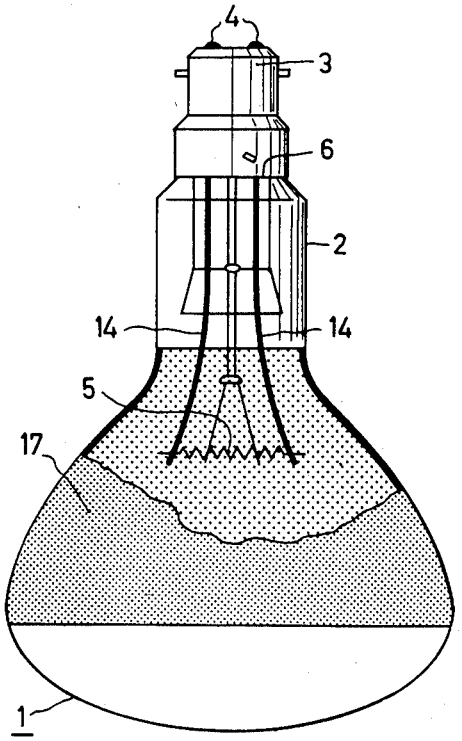
FIG. 1 is a side elevation of a lamp partly broken away.

The lamp cap 3 (FIG. 2) has in its outer surface an elongate depression and consequently at the inner surface a corresponding projection 7 and a diametrically opposed second projection not visible in the Figure. As a guide, a linear groove 8 is provided in the neck-shaped portion 2, which groove has been caused to engage the projection 7 by a rotation of the lamp cap 3 in the counter-clockwise direction (arrow 11) with respect to the lamp envelope 1 until the limit is reached when the edge 6 abuts the envelope and thereby prevents further rotation. The groove 8 is linear and therefore has a constant pitch and is at a constant angle with the axis 13 of the lamp cap 3.

In the region 9 between the neck-shaped portion 2 and the lamp cap 3, there is provided a solidified mass 10 which locks the coupling established by the projections 7 and the guides 8 and wherein the projections 7 are embedded.

When the lamp is arranged in a lamp holder by rotation in the direction of the arrow 12, the lamp cap 3 would become detached without the solidified mass 10. However, the mass 10 has not yet been thermally loaded and is consequently capable of withstanding the occurring force and therefore satisfactorily locks the coupling against displacement. If, at the end of its life, however, the lamp is removed from the lamp holder by rotation in a direction opposite to that of the arrow 12, frictional forces in the holder which may be increased by corrosion, exert a torque in the direction of the arrow 11. The two torques, i.e. the torque exerted by the operator and the torque produced in the lamp cap, then have a tendency to strengthen the mechanical coupling between the lamp cap 3 and the neck-shaped portion 2 by virtue of the projections 7 and the guides 8. The solidified mass 10 then need not contribute to that coupling.

Figure 2:
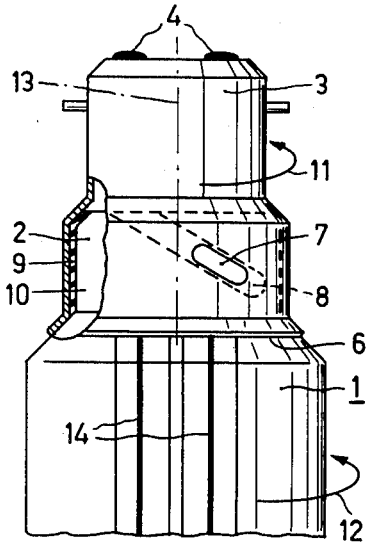
FIG. 2 shows a detail of FIG. 1.
Figure 3:
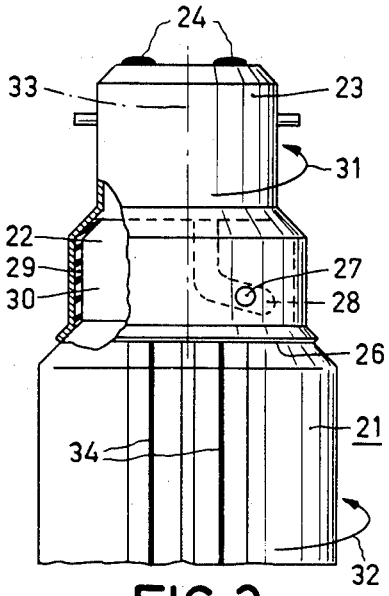
FIG. 3 shows a first modification of FIG. 2.

In FIG. 3, corresponding parts are each designated by a reference numeral which is 20 higher than in FIG. 2. The lamp cap 23 has a circular depression in its outer surface and a corresponding projection 27 at its inner surface. The groove 28 is curved so that it has, at axial locations spaced from the free end of the neck-shaped lamp envelope part 22, a decreasing pitch.

Figure 4:
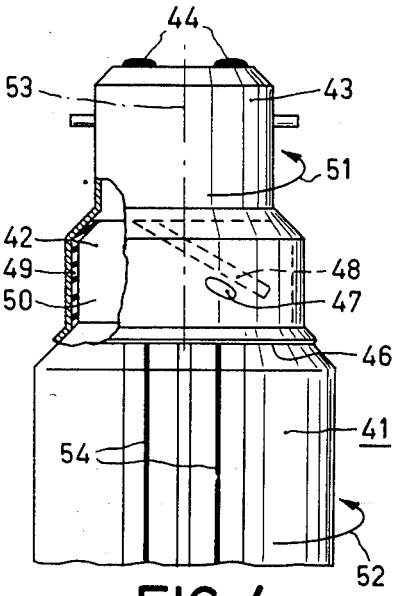
FIG. 4 shows a second modification of FIG. 2.

In FIG. 4, corresponding parts are denoted by reference numerals which are 20 higher than in the preceding Figure. The guides 48 in this case each consist of a boss on the surface of the neck-shaped portion 42.

EXAMPLE

A lamp as shown in FIGS. 1 and 3 was operated for 5000 hours, i.e., its calculated life, in a drying tunnel in which the temperature was 275° C. Subsequently, the lamp was removed from the lamp holder and examined. The mass used as the means for locking against displacement had become brittle. In a similar lamp, but without means other than the solidified mass for securing the lamp cap, the mass no longer established a coupling and the lamp cap remained in the lamp holder.

In the lamp according to the invention, on the contrary, the lamp envelope and the lamp cap were still united. The solidified mass used was a suspension of the following composition, expressed in % by weight:

| | |
|---|---|
| shellac | 2.4 |
| phenol formaldehyde | 1.9 |
| hexamethylene tetra-amin | 0.3 |
| silicon resin | 6.5 |
| limestone | 81.2 |
| ethanol | 7.0 |
| n.butanol | 0.7. |

This suspension was provided in the lamp cap, after which the lamp cap was placed on the lamp envelope and the suspension was caused to solidify by a short heat treatment. The suspension agent then evaporated for the major part and the mass hardened.

What is claimed is:

1. An electric lamp comprising a blown glass lamp envelope having a neck-shaped portion, a bayonet lamp cap, and current-supply conductors extending from contacts on the lamp cap through the wall of the lamp envelope to an electric element arranged inside the lamp envelope; which lamp cap surrounds at least part of the neck-shaped portion and is coupled to the envelope, by means of circumferentially distributed projections and respective guides cooperating therewith, such that an edge of the lamp cap abuts the envelope, the coupling being locked against displacement by means of a solidified mass, characterized in that the guides are so arranged that the coupling is established by relative rotation in the counter-clockwise direction between the lamp cap and the lamp envelope, the abutting of the cap against the envelope stopping further rotation.

2. An electric lamp as claimed in claim 1, characterized in that the lamp envelope has a mirror-coated wall portion.

3. An electric lamp as claimed in claim 1, characterized in that the projections and the guides are embedded in the solidified mass.

4. An electric lamp as claimed in claim 3, characterized in that the lamp envelope has a mirror-coated wall portion.

* * * * *